US006685036B2

(12) United States Patent
de Jenlis et al.

(10) Patent No.: US 6,685,036 B2
(45) Date of Patent: Feb. 3, 2004

(54) STACKING DISPLAY LEVEL DIVIDER WITH OPPOSITELY-ATTACHED SHEETS

(75) Inventors: Pascal de Jenlis, Belmonte (FR); André Le Borgne, Guidel (FR)

(73) Assignee: Hameur S.A., Pontpierre (LU)

( * ) Notice: Subject to any disclaimer, the term of this patent is extended or adjusted under 35 U.S.C. 154(b) by 119 days.

(21) Appl. No.: 09/892,361

(22) Filed: Jun. 27, 2001

(65) Prior Publication Data

US 2002/0023887 A1 Feb. 28, 2002

(30) Foreign Application Priority Data

Jun. 28, 2000 (FR) ..... 00 07097

(51) Int. Cl.[7] ..... A47F 7/00

(52) U.S. Cl. ..... 211/59.4; 211/194; 206/821; 220/512; 220/514

(58) Field of Search ..... 211/59.4, 194, 211/126.1, 74, 49.1, 50; 108/91, 53.1, 53.3, 55.3; 220/513, 514, 516, 519, 510, 512, 529; 206/509, 504, 511, 515, 516, 503, 519, 429, 427, 564, 821

(56) References Cited

U.S. PATENT DOCUMENTS

| | | | | | |
|---|---|---|---|---|---|
| 2,535,493 | A | * | 12/1950 | Gerber | 220/97 |
| 2,928,200 | A | | 3/1960 | Shiels | 40/310 |
| 3,106,308 | A | | 10/1963 | Kazimier | 220/21 |
| 4,037,722 | A | * | 7/1977 | Bremer | 206/523 |
| 4,344,530 | A | * | 8/1982 | deLarosiere | 206/203 |
| 4,653,651 | A | * | 3/1987 | Flum | 211/59.4 |
| 4,865,202 | A | * | 9/1989 | Day | 206/597 |
| 4,930,653 | A | * | 6/1990 | Machado | 220/23.4 |
| 5,009,314 | A | * | 4/1991 | Arthurs | 206/427 |
| 5,016,761 | A | | 5/1991 | Stoddard et al. | 211/59.4 |
| 5,060,819 | A | * | 10/1991 | Apps | 220/519 |
| 5,144,897 | A | * | 9/1992 | Avery | 108/55.3 |
| 5,277,316 | A | * | 1/1994 | Apps et al. | 206/503 |
| 5,377,862 | A | * | 1/1995 | Oakes et al. | 206/151 |
| 5,379,905 | A | * | 1/1995 | Bustos et al. | 211/59.2 |
| 5,501,352 | A | * | 3/1996 | Apps | 220/509 |
| 5,529,176 | A | * | 6/1996 | Apps et al. | 206/201 |
| 5,638,760 | A | * | 6/1997 | Jordan et al. | 108/51.1 |
| 6,021,913 | A | | 2/2000 | McGrath | 220/513 |
| 6,082,542 | A | * | 7/2000 | McGrath et al. | 206/519 |
| 6,289,823 | B1 | * | 9/2001 | Koefelda et al. | 108/53.3 |

FOREIGN PATENT DOCUMENTS

| | | | |
|---|---|---|---|
| FR | 2810866 | A1 * | 10/2002 |
| WO | WO 96/33919 | | 10/1996 |

* cited by examiner

*Primary Examiner*—Daniel P. Stodola
*Assistant Examiner*—Jennifer E. Novosad
(74) *Attorney, Agent, or Firm*—Duane Morris LLP

(57) ABSTRACT

A support or divider element between layers of objects displayed in a stack has two identical sheets, assembled facing in opposite directions. The top sheet of a divider element holds the bottoms of objects in a next upper layer. The bottom sheet of an identical element, facing in the opposite direction, holds the tops of the objects in the next lower layer. The oppositely facing sheets are snapped together by engaging protuberances and hollows. A space between edges of the assembled sheets can receive a printed or decorated band.

11 Claims, 3 Drawing Sheets

STACKING DISPLAY LEVEL DIVIDER WITH OPPOSITELY-ATTACHED SHEETS

BACKGROUND OF THE INVENTION

The purpose of the present invention is packaging forming a stacking display unit for objects at point of sale, intended in particular, but not exclusively, for sale of disposable lighters.

Point of sale display units are generally known and are usually made up of a flat surface with cells into which the objects are partially inserted and from which it is, in principle, easy to remove them. But the capacity to display objects on such surfaces is limited to the extent that they are distributed on one level.

Also known are grouping stands in which sufficiently rigid objects are arranged by being held at a predetermined distance from each other on a base by means of low-walled cells enclosing the bases of the objects, their tops being held by heat-shrinkable film. But opening the film frees up all the objects. And single objects cannot usually be stacked.

A first purpose of the invention is to remedy these drawbacks and to allow for an attractive presentation while allowing individual objects, arranged in stacks by layers on top of each other, to be easily grasped, the objects themselves ensuring the rigidity of the connection between the layers by means of supports.

According to the invention, a display unit of stacked objects, comprises a base, a cover, and at least one divider element, equipped with means to position the objects. The edge of a dividing element has a recess allowing for a printed or decorated band to be placed on its exterior surface.

When the brand name of the objects cannot be placed on the objects themselves, the invention allows it to be displayed with the objects.

According to another characteristic of the invention, the display unit comprises a sheet formed with cells into which the said objects are partially inserted. The objects are separated by layers, with dividing elements are made up of at least one sheet formed with cells into which the bottoms of the objects are introduced, the opposite side of the support being equipped to hold the tops of the objects on a next lower level.

Each divider element presents a surface with cells for holding the bottom of an object and an opposite side designed to hold the top of an object. It is thus possible to stack the objects by layers or levels on top of each other to obtain compact packaging.

The bottom of the objects is enclosed in the cells of the lower element, the top of the objects, covered by the cells of the upper divider element, not being visible, the stack seeming to support itself alone.

On the top of the stack is placed a cover or sheet, optionally identical to the sheets forming the divider elements, with cells formed at least to hold the tops. Protuberances and hollows allow for assembly of the divider elements alone, before they are filled with objects, without loss of space. This assembly immobilizes the sheets constituting the divider elements, and then the objects, one in relation to the other.

According to another characteristic of the invention, a divider element is formed of two identical sheets assembled by snapping them together in opposite directions. Manufacturing cost is thus reduced. The base of the stack is preferably made of two sheets, like the divider elements.

The elements or supports containing the hollow and protruding cells are separated by a recess where a band with an informational message, such as a brand name or other message useful to the consumer, can be placed.

The stack thus constituted can be arranged for transport in cardboard outer packaging, itself clad with blister packaging or heat-shrinkable film. At the point of sale, the stack, in block or lot form, is removed from the carton and placed within reach of purchasers. The flat rectangular form of the base makes the stack self-stabilizing.

BRIEF DESCRIPTION OF THE DRAWINGS

Characteristics and advantages of the invention will appear in the course of the A, following description of a particular method of using the invention, given only as a non-limiting example, in comparison with the drawings, which represent.

DETAILED DESCRIPTION

In all the figures, the same references designate the same elements. In the example that will now be described, the objects to be grouped are lighters in the usual parallelepiped form with rounded front and back sides.

Figure 1:
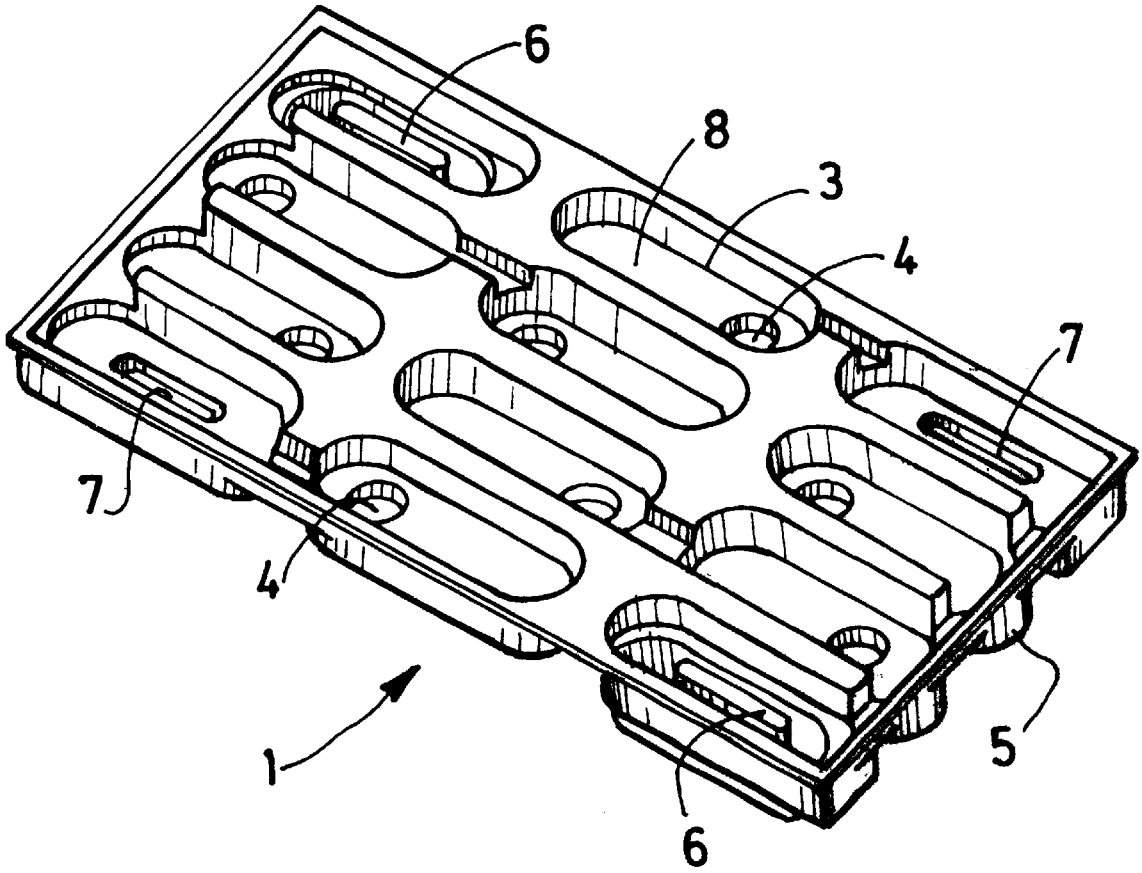
FIG. 1, a view of the sheet that, with a similar sheet, will constitute a support according to the invention.

FIG. 1 shows a sheet designated generally with the reference 1. This sheet will be used on the one hand to form the divider elements that support the levels or layers of the objects 0 (see also FIG. 3) and, on the other, as a cover for the top of the stack. The sheet 1 is made up of a thin layer of plastic material that can be heat molded. It comprises a group of cells 3 formed to hold, with friction, the bottom of the body of an object. In the example shown, the sheet is rectangular and has twelve cells, divided into three rows and four lines. Inside these cells are cavities 4, the bottoms of which are intended to serve as stops after assembly of the two sheets 1 as will be explained further on. In the corners of the rectangle, there are no cavities in the cells but, on one diagonal, two protuberances 6 and, on the other diagonal, two hollows 7, the protuberances 6 being inserted into the hollows 7 to allow for assembly of two sheets constituting a support. These protuberances and hollows, forming tenons and mortises, are provided so that one sheet can be snapped onto another to constitute a divider support. The surface 8 for placing the base of the objects is the same on every sheet. The upper surface of the protuberances 6 is at the same level as the bottom 5 of the cells 3. The sheets 1 are stackable in one direction (without space between the sheets) and can be grouped together in opposite directions.

Figure 2:
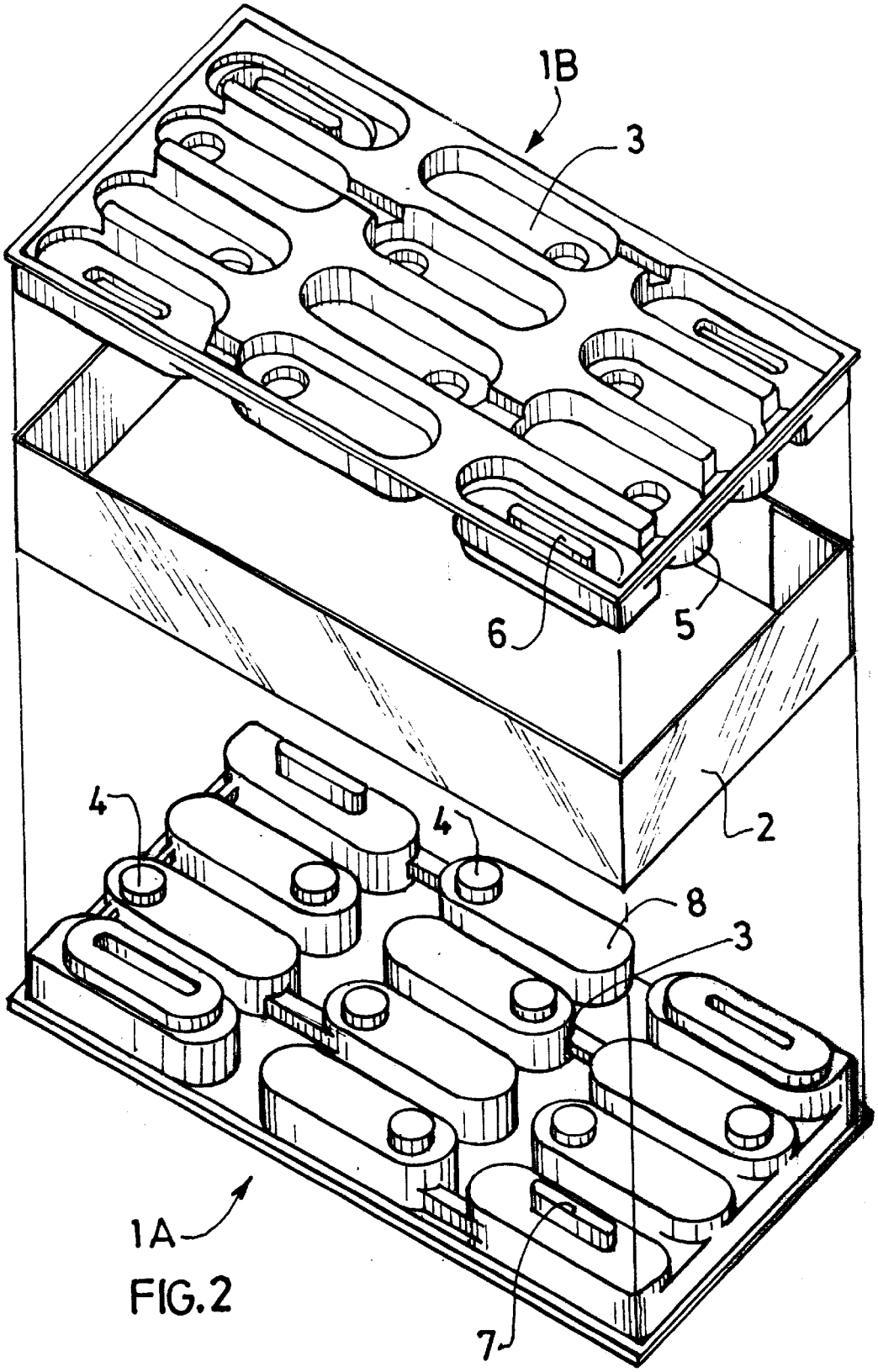
FIG. 2, an exploded view of a support of a layer.

FIG. 2 is an exploded view of the divider element 1, constituted by back-to-back assembly of two sheets respectively 1A for the base and 1B for the top. Sheets 1A and 1B are represented in the assembly position. Sheet 1B is in the same position as the sheet represented in FIG. 1. In relation to this position, sheet 1A is turned 180° so that the cells 3, hollow on sheet 1B, are protruding on sheet 1A. The stops 4 come to rest against the bottom 5 of the cells in the opposite sheet to ensure rigidity of the whole assembly. The protuberances 6 of sheet 1A can thus snap into the hollows 7 of sheet 1B and vice versa. Sheets 1A and 1B being assembled in opposite directions, the cells of each sheet face one another.

To conceal the different assembly components, the protruding edges of the two sheets 1A and 1B have a recessed surface into which a paper or cardboard band 2 can be placed for decoration and/or information on the product, its manufacturer or distributor. The necessary indications thus appear on the edge of the divider elements and the base and/or the cover.

On its under-side, such a support 1A, 1B, 10 can hold the tops of the objects of one layer, and on its top-side, the support can hold the bases of the objects of the next upper layer. The support constitutes a divider between the two layers. The edge of the support forms a recess into which is inserted a band 2 with printed information.

Figure 3:
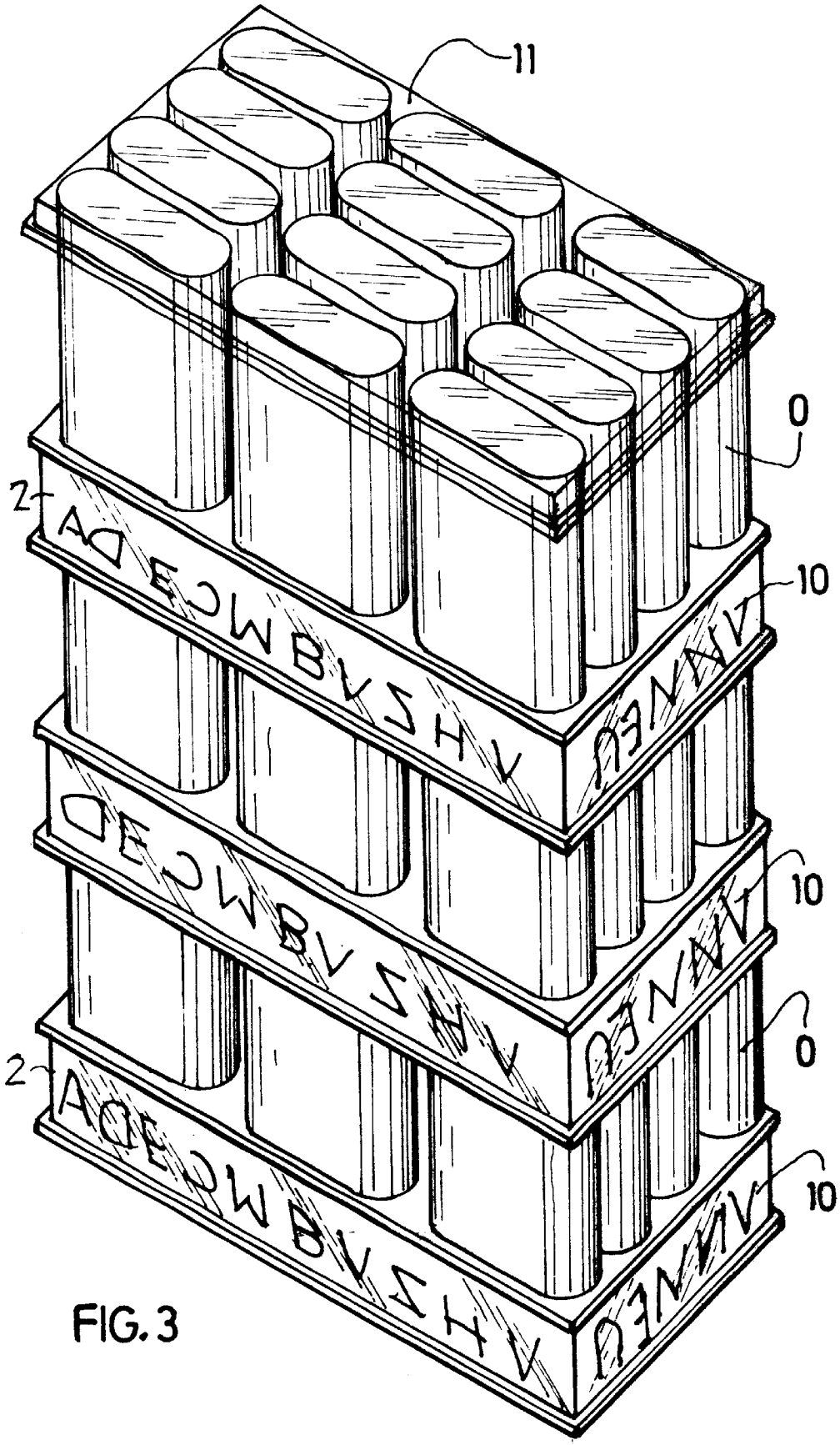
FIG. 3, a view of a stack of objects.

As appears in FIG. 3, where only the body of the lighters "0" has been represented, the base of the stack is constituted by a support 10 of the type previously described of which only the upper part is used to hold the bottom of the objects 0 of the lowest level.

The intermediate levels are held between two intermediate supports 10 and the top of the objects is covered with a single sheet 11 before insertion of the stack into cardboard packaging under a blister, for example.

Of course, numerous variations can be made, in particular by substitution of equivalent technical methods, without going beyond the context of the invention.

What is claimed is:

1. A stacking unit for positioning between a plurality of objects each having a top portion and a bottom portion, the stacking unit comprising:

first and second sheets that are identical to one another, each of the sheets defined by a first side and a second side, the sheets having a plurality of cells each having a substantially open upper end on the first side and the sheets each having at least a protuberance and a hollow;

wherein the first and second sheets are assembled together to form both a first position for display and a second position for storage, whereby the sheets are assembled in the first position by facing the sheets in opposite directions such that the second side of the first sheet faces the second side of the second sheet so that the protuberances and hollows of the sheets facing in opposite directions are snapped together to thereby form a divider element that can be placed between the objects to thereby form upper and lower layers of the objects wherein the bottom portions of the objects are received in the cells of the first sheet and the top portions of the objects are received in the cells of the second sheet; and the sheets are assembled in the second position by facing the sheets such that the second side of the first sheet faces the first side of the second sheet so that the sheets can be stacked together.

2. The stacking unit according to claim 1, wherein each of the sheets comprises a plurality of protuberances and hollows, at least partly distributed in corners of the sheets.

3. The stacking unit according to claim 1, wherein the protuberances and hollows are at least partly provided in the cells, the cells forming cavities that provide a stop.

4. The stacking unit according to claim 1, wherein the first and second sheets when assembled together by facing the sheets in opposite directions have edges that are spaced from one another to provide a recess.

5. The stacking unit according to claim 4, further comprising a band adapted to fit into the recess, the band having at least one of printing and decoration.

6. A stacking unit for positioning between a plurality of objects each having a top portion and a bottom portion, the stacking unit comprising:

first and second sheets that are identical to one another, each of the sheets defined by a first side and a second side, the sheets having a plurality of cells each having a substantially open upper end on the first side and the sheets each having at least one protuberance and at least one hollow;

wherein the first and second sheets are assembled together in a display position by facing the sheets in opposite directions such that the second side of the first sheet faces the second side of the second sheet so that the protuberances and hollows of the sheets are snapped together to thereby form a divider element that can be placed between the objects to thereby form upper and lower layers of the objects wherein the bottom portions of the objects are received in the cells of the first sheet and the top portions of the objects are received in the cells of the second sheet.

7. The stacking unit of claim 6, wherein the sheets can also be assembled together in a storage position by facing the sheets such that the second side of the first sheet faces the first side of the second sheet so that the sheets are stacked together.

8. The stacking unit according to claim 6, wherein each of the sheets comprises a plurality of protuberances and hollows, at least partly distributed in corners of the sheets.

9. The stacking unit according to claim 6, wherein the protuberances and hollows are at least partly provided in the cells, the cells forming cavities that provide a stop.

10. The stacking unit according to claim 6, wherein the first and second sheets when assembled together by facing the sheets in opposite directions have edges that are spaced from one another to provide a recess.

11. The stacking unit according to claim 10, further comprising a band adapted to fit into the recess, the band having at least one of printing and decoration.

* * * * *